US012419343B2

(12) United States Patent
Ademe

(10) Patent No.: US 12,419,343 B2
(45) **Date of Patent: *Sep. 23, 2025**

(54) APPARATUS FOR RECOVERING TOBACCO MATERIAL AND RELATED METHOD

(71) Applicant: R.J. Reynolds Tobacco Company, Winston-Salem, NC (US)

(72) Inventor: Balager Ademe, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 113 days.

This patent is subject to a terminal disclaimer.

(21) Appl. No.: 18/455,246

(22) Filed: Aug. 24, 2023

(65) Prior Publication Data

US 2023/0397652 A1 Dec. 14, 2023

Related U.S. Application Data

(63) Continuation of application No. 17/307,925, filed on May 4, 2021, now Pat. No. 11,771,130, which is a (Continued)

(51) Int. Cl.

| | |
|---|---|
| ***A24C 5/345*** | (2006.01) |
| ***A24C 5/32*** | (2006.01) |
| ***A24C 5/36*** | (2006.01) |

(52) U.S. Cl.

CPC ..... *A24C 5/36* (2013.01); *A24C 5/322* (2013.01); *A24C 5/345* (2013.01)

(58) Field of Classification Search

CPC ..... A24C 5/31; A24C 5/322; A24C 5/345; A24C 5/36

See application file for complete search history.

(56) References Cited

U.S. PATENT DOCUMENTS

| | | | |
|---|---|---|---|
| 3,255,762 | A | 6/1966 | Baier |
| 3,288,147 | A | 11/1966 | Molins et al. |

(Continued)

FOREIGN PATENT DOCUMENTS

| | | |
|---|---|---|
| CN | 2205111 | 8/1995 |
| CN | 203801718 | 9/2014 |

(Continued)

OTHER PUBLICATIONS

Davis et al., *Tobacco Production, Chemistry and Technology*, 1999, pp. 440-460, Blackwell Science, Inc., Malden, MA.

(Continued)

*Primary Examiner* — Eric Yaary

(74) *Attorney, Agent, or Firm* — Womble Bond Dickinson (US) LLP

(57) ABSTRACT

An apparatus and method for recovering tobacco material from tobacco rod sections is provided, each tobacco rod section including a wrapping paper wrapped about the tobacco material. The apparatus includes a centrifugal object-orienting device including a disc disposed at an incline within a cylindrical container, the cylindrical container and the disc being rotatable about a rotation axis such that the rotating cylindrical container and disc impart centrifugal force to the tobacco rod sections, the tobacco rod sections being responsive to the centrifugal force to orient lengthwise. A first conveyor device is configured to receive and convey in a conveyor direction the tobacco rod sections, with the tobacco rod sections being oriented lengthwise relative to the conveyor direction. A slitting device is operably engaged with the first conveyor device and configured to lengthwise slit the wrapping paper wrapped about the tobacco material of each of the tobacco rod sections.

28 Claims, 4 Drawing Sheets

Related U.S. Application Data continuation of application No. 16/052,312, filed on Aug. 1, 2018, now Pat. No. 11,033,049.

(56) References Cited

U.S. PATENT DOCUMENTS

| | | | |
|---|---|---|---|
| 3,308,600 | A | 3/1967 | Erdmann et al. |
| 3,616,901 | A | 11/1971 | Groves |
| 3,915,176 | A | 10/1975 | Heitmann et al. |
| 4,004,593 | A | 1/1977 | Kaeding et al. |
| 4,191,046 | A | 3/1980 | Baker et al. |
| 4,191,199 | A | 3/1980 | Sullivan |
| 4,221,035 | A | 9/1980 | Thatcher |
| 4,278,100 | A | 7/1981 | Thatcher |
| 4,280,187 | A | 7/1981 | Reuland et al. |
| 4,281,670 | A | 8/1981 | Heitmann et al. |
| 4,291,713 | A | 9/1981 | Frank |
| 4,474,190 | A | 10/1984 | Brand |
| 4,574,816 | A | 3/1986 | Rudszinat |
| 4,736,754 | A | 4/1988 | Heitmann et al. |
| 4,763,673 | A | 8/1988 | Barnes et al. |
| 4,781,203 | A | 11/1988 | La Hue |
| 4,836,224 | A | 6/1989 | Lawson et al. |
| 4,844,100 | A | 7/1989 | Holznagel |
| 4,862,905 | A | 9/1989 | Green, Jr. et al. |
| 4,867,179 | A | 9/1989 | Leonard |
| 4,878,506 | A | 11/1989 | Pinck et al. |
| 4,924,888 | A | 5/1990 | Perfetti et al. |
| 5,000,196 | A | 3/1991 | Stewart et al. |
| 5,001,951 | A | 3/1991 | Eisenlohr et al. |
| 5,012,823 | A | 5/1991 | Keritsis et al. |
| 5,056,537 | A | 10/1991 | Brown et al. |
| 5,060,665 | A | 10/1991 | Heitmann |
| 5,117,843 | A | 6/1992 | Holmes et al. |
| 5,156,169 | A | 10/1992 | Holmes et al. |
| 5,191,906 | A | 3/1993 | Myracle, Jr. |
| 5,220,930 | A | 6/1993 | Gentry |
| 5,360,023 | A | 11/1994 | Blakley et al. |
| 6,134,948 | A | 10/2000 | Fuchigami et al. |
| 6,229,115 | B1 | 5/2001 | Voss et al. |
| 6,264,591 | B1 | 7/2001 | Keen et al. |
| 6,276,366 | B1 | 8/2001 | Fuchigami et al. |
| 6,360,751 | B1 | 3/2002 | Fagg et al. |
| 6,510,855 | B1 | 1/2003 | Korte et al. |
| 6,647,878 | B2 | 11/2003 | Blau et al. |
| 6,701,936 | B2 | 3/2004 | Shafer et al. |
| 6,779,530 | B2 | 8/2004 | Kraker |
| 6,848,449 | B2 | 2/2005 | Kitao et al. |
| 6,904,917 | B2 | 6/2005 | Kitao et al. |
| 7,025,066 | B2 | 4/2006 | Lawson et al. |
| 7,210,486 | B2 | 5/2007 | Hartmann |
| 7,234,471 | B2 | 6/2007 | Fitzgerald et al. |
| 7,237,559 | B2 | 7/2007 | Ashcraft et al. |
| 7,240,678 | B2 | 7/2007 | Crooks et al. |
| 7,275,548 | B2 | 10/2007 | Hancock et al. |
| 7,281,540 | B2 | 10/2007 | Barnes et al. |
| 7,296,578 | B2 | 11/2007 | Read, Jr. |
| 7,434,585 | B2 | 10/2008 | Holmes |
| 7,479,098 | B2 | 1/2009 | Thomas et al. |
| 7,565,818 | B2 | 7/2009 | Thomas et al. |
| 7,833,146 | B2 | 11/2010 | Deal |
| 7,836,895 | B2 | 11/2010 | Dube et al. |
| 7,972,254 | B2 | 7/2011 | Stokes et al. |
| 7,984,719 | B2 | 7/2011 | Dube et al. |
| 8,262,550 | B2 | 9/2012 | Barnes et al. |
| 8,303,474 | B2 | 11/2012 | Iliev et al. |
| 8,353,810 | B2 | 1/2013 | Cieslikowski et al. |
| 8,381,947 | B2 | 2/2013 | Garthaffner et al. |
| 8,459,272 | B2 | 6/2013 | Karles et al. |
| 9,055,768 | B2 | 6/2015 | Henley et al. |
| 9,295,284 | B2 | 3/2016 | Prestia et al. |
| 9,339,060 | B2 | 5/2016 | Hartmann et al. |
| 2003/0136419 | A1 | 7/2003 | Muller |
| 2003/0221696 | A1 | 12/2003 | Gherardi |
| 2004/0255965 | A1 | 12/2004 | Perfetti et al. |
| 2005/0066986 | A1 | 3/2005 | Nestor et al. |
| 2006/0272293 | A1 | 12/2006 | Nelson et al. |
| 2007/0000503 | A1 | 1/2007 | Herrmann et al. |
| 2007/0246055 | A1 | 10/2007 | Oglesby |
| 2008/0092912 | A1 | 4/2008 | Robinson et al. |
| 2014/0190496 | A1 | 7/2014 | Wensley et al. |
| 2014/0290671 | A1 | 10/2014 | Park et al. |
| 2016/0120213 | A1 | 5/2016 | Ademe et al. |
| 2016/0374388 | A1 | 12/2016 | Thomson |
| 2017/0181474 | A1 | 6/2017 | Cameron |
| 2017/0265517 | A1 | 9/2017 | Swede et al. |
| 2017/0290671 | A1 | 10/2017 | Milz et al. |

FOREIGN PATENT DOCUMENTS

| | | | | |
|---|---|---|---|---|
| CN | 203801718 U | * | 9/2014 | |
| DE | 4319957 | | 11/1994 | |
| EP | 3266319 | | 1/2018 | |
| GB | 191007594 | | 1/1911 | |
| GB | 612294 | | 11/1948 | |
| GB | 1376747 | | 12/1974 | |
| GB | 2039714 | | 8/1980 | |
| WO | WO 02/37990 | | 5/2002 | |
| WO | WO 2004/047572 | | 6/2004 | |
| WO | WO 2004/057986 | | 7/2004 | |
| WO | WO 2014/072175 | | 5/2014 | |
| WO | WO-2014072175 A1 | * | 5/2014 | ..... A24C 5/36 |
| WO | WO 2014/155327 | | 10/2014 | |

OTHER PUBLICATIONS

Bombick et al., "Evaluation of the Genotoxic and Cytotoxic Potential of Mainstream Whole Smoke and Smoke Condensate from a Cigarette Containing a Novel Carbon Filter," Fundamental and Applied Toxicology, 1997, vol. 39, pp. 11-17.

Gutcho, "Tobacco Flavoring Substances and Methods," Noyes Data Corp, 1972.

Leffingwell, et al., Tobacco Flavoring for Smoking Products, R.J. Reynolds Tobacco Company, 1972.

* cited by examiner

APPARATUS FOR RECOVERING TOBACCO MATERIAL AND RELATED METHOD

CROSS-REFERENCE TO RELATED APPLICATIONS

This application is a continuation of U.S. application Ser. No. 17/307,925, filed May 4, 2021, which is a continuation of U.S. application Ser. No. 16/052,312, filed Aug. 1, 2018, which issued as U.S. Pat. No. 11,033,049, on Jun. 15, 2021, which applications are hereby incorporated by reference in their entirety in this application.

BACKGROUND OF THE DISCLOSURE

Field of the Disclosure

The present disclosure relates to products made or derived from tobacco, or that otherwise incorporate tobacco, and are intended for human consumption; and more particularly, to an apparatus and related method for recovering tobacco material from components of produced smoking articles and/or portions thereof.

Disclosure of Related Art

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod", "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping paper known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999); which is incorporated herein by reference. A traditional type of cigarettes is employed by a smoker by lighting one end thereof and burning the tobacco rod. The smoker then receives mainstream smoke into his/her mouth by drawing on the opposite end (e.g., the filter end or mouth end) of the cigarette.

Certain types of smoking articles can possess filter elements that incorporate objects, such as pellets, beads and breakable capsules. Various components of such filter elements, as well as equipment and techniques for manufacturing such filter elements, are set forth and referenced, for example, in U.S. Pat. No. 4,862,905 to Green, Jr. et al.; U.S. Pat. No. 7,479,098 to Thomas et al.; U.S. Pat. No. 7,833,146 to Deal; U.S. Pat. No. 7,984,719 to Dube et al.; U.S. Pat. No. 7,972,254 to Stokes et al.; U.S. Pat. No. 8,262,550 to Barnes et al.; U.S. Pat. No. 8,303,474 to Iliev et al.; U.S. Pat. No. 8,353,810 to Garthaffner et al.; U.S. Pat. No. 8,381,947 to Garthaffner et al.; U.S. Pat. No. 8,459,272 to Karles et al.; U.S. Pat. No. 9,295,284 to Prestia et al.; U.S. Pat. No. 9,055,768 to Henley et al.; and U.S. Pat. No. 9,339,060 to Hartmann et al., which are incorporated herein by reference. Representative cigarette products that possess filter elements incorporating breakable capsules have been marketed throughout the world under the brand names such as, for example, "MARLBORO W-BURST 5," "CAMEL CRUSH," "KENT ISWITCH," and "KOOL BOOST."

During manufacture of smoking articles, such as cigarettes, certain defects may be encountered. For example, the cigarette may be missing the filter section; the tipping paper may be torn or improperly/incompletely applied; the air dilution perforations may be incompletely or improperly formed; the wrapping paper for the tobacco rod section may be torn or improperly formed; the tobacco rod section may have a low weight/density, a high weight/density, a soft spot, a hard spot, loose tobacco about the lighting end of the tobacco rod section, an improper density profile along the tobacco rod section; and/or a visible defect. In instances of such defects, it may be impractical to "re-work" the defective cigarette. As such, cigarettes with detected defects are often rejected as scrap or waste. However, disposing of such defective cigarettes may represent a significant monetary loss in terms of the valuable tobacco material within the tobacco rod section. In some instances, it may be difficult or impractical to recover the tobacco material from such defective cigarettes, as the recovered tobacco material must desirably be free of contaminants (i.e., the filter section, the tipping paper, the wrapping paper, etc.), and the recovered tobacco material must be of the same blend, so as to be "re-usable" for manufacturing other non-defective cigarettes.

Therefore, it would be highly desirable to provide a manner or method, and associated apparatus, for recovering tobacco material from identified as defective smoking articles at various points during the manufacture of a certain type of cigarette. Further, it would be desirable for the tobacco recovery process to be automated and capable of recovering the tobacco material from the certain type of cigarette, without contaminating the recovered tobacco material.

BRIEF SUMMARY OF THE DISCLOSURE

The above and other needs are met by aspects of the present disclosure which, in one aspect, provides an apparatus for recovering tobacco material from tobacco rod sections, each tobacco rod section including a wrapping paper wrapped about the tobacco material. Such an apparatus comprises a centrifugal object-orienting device comprising a wall defining a cylindrical container arranged to receive the tobacco rod sections and defining a central axis therein, a rim arranged adjacent to and extending at least partially about an upper end of the wall, and a disc disposed at an incline within the cylindrical container and so as to interact with the rim, the cylindrical container and the disc being rotatable about a rotation axis such that the rotating cylindrical container and disc impart centrifugal force to the tobacco rod sections within the cylindrical container, the tobacco rod sections being responsive to the centrifugal force to orient lengthwise along the wall and to be deposited in a lengthwise orientation on the rim where the disc interacts with the rim. A first conveyor device is disposed adjacent to and configured to interact with the rim so as to receive and convey in a conveyor direction the tobacco rod sections from the rim, with the tobacco rod sections being oriented lengthwise relative to the conveyor direction. A slitting device is operably engaged with the first conveyor device and configured to lengthwise slit the wrapping paper wrapped about the tobacco material of each of the tobacco rod sections conveyed by the first conveyor device.

Another aspect of the present disclosure provides a method of recovering tobacco material from tobacco rod sections, wherein each tobacco rod section includes a wrapping paper wrapped about the tobacco material. Such a method comprises receiving the tobacco rod sections in a cylindrical container defined by a wall of a centrifugal object-orienting device, the cylindrical container having therein a disc disposed at an incline within the cylindrical container so as to interact with a rim arranged adjacent to and extending at least partially about an upper end of the wall of the cylindrical container. The cylindrical container and the disc are rotated about a rotation axis so as to impart a centrifugal force to the tobacco rod sections within the cylindrical container, the tobacco rod sections being responsive to the centrifugal force so as to orient lengthwise along the wall and be deposited in a lengthwise orientation on the rim where the disc interacts with the rim. The tobacco rod sections are conveyed in a conveyor direction from the rim of the centrifugal object-orienting device by a first conveyor device, the first conveyor device being disposed adjacent to and configured to interact with the rim so as to receive the tobacco rod sections oriented lengthwise relative to the conveyor direction. Each of the tobacco rod sections received by the first conveyor are slit using a slitting device operably engaged with the first conveyor device so as to lengthwise slit the wrapping paper wrapped about the tobacco material of each of the tobacco rod sections conveyed by the first conveyor device.

Further features and advantages of the present disclosure are set forth in more detail in the following description.

BRIEF DESCRIPTION OF THE DRAWINGS

Figure 1:
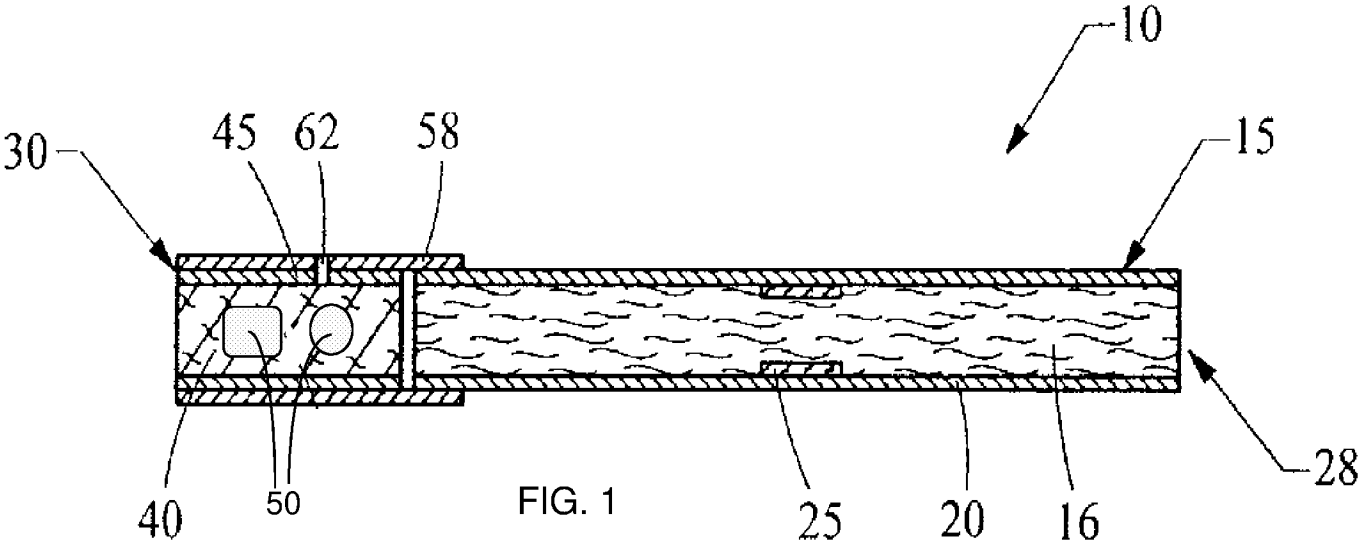
Figure 2:
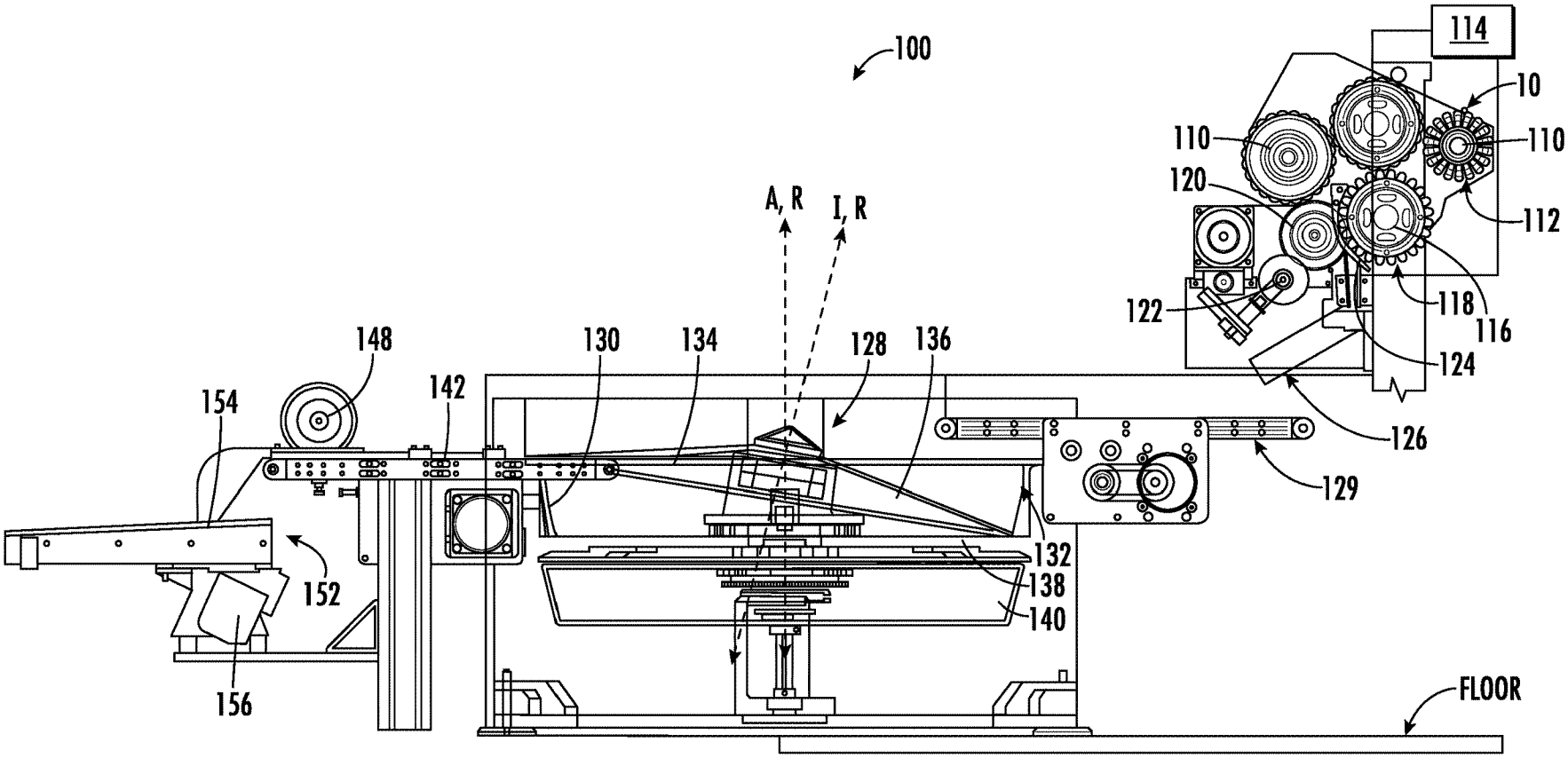
Figure 3:
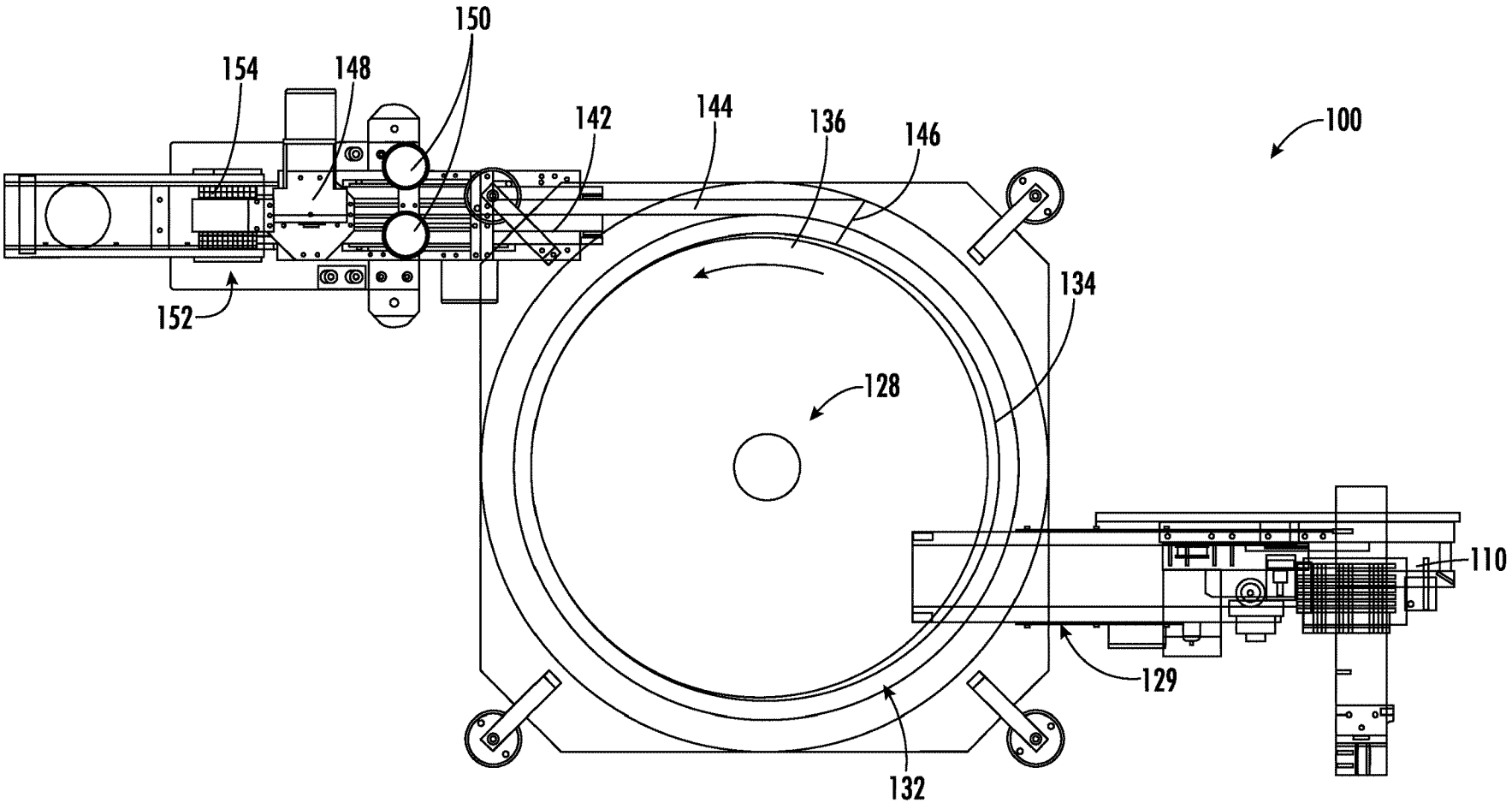
Figure 4:
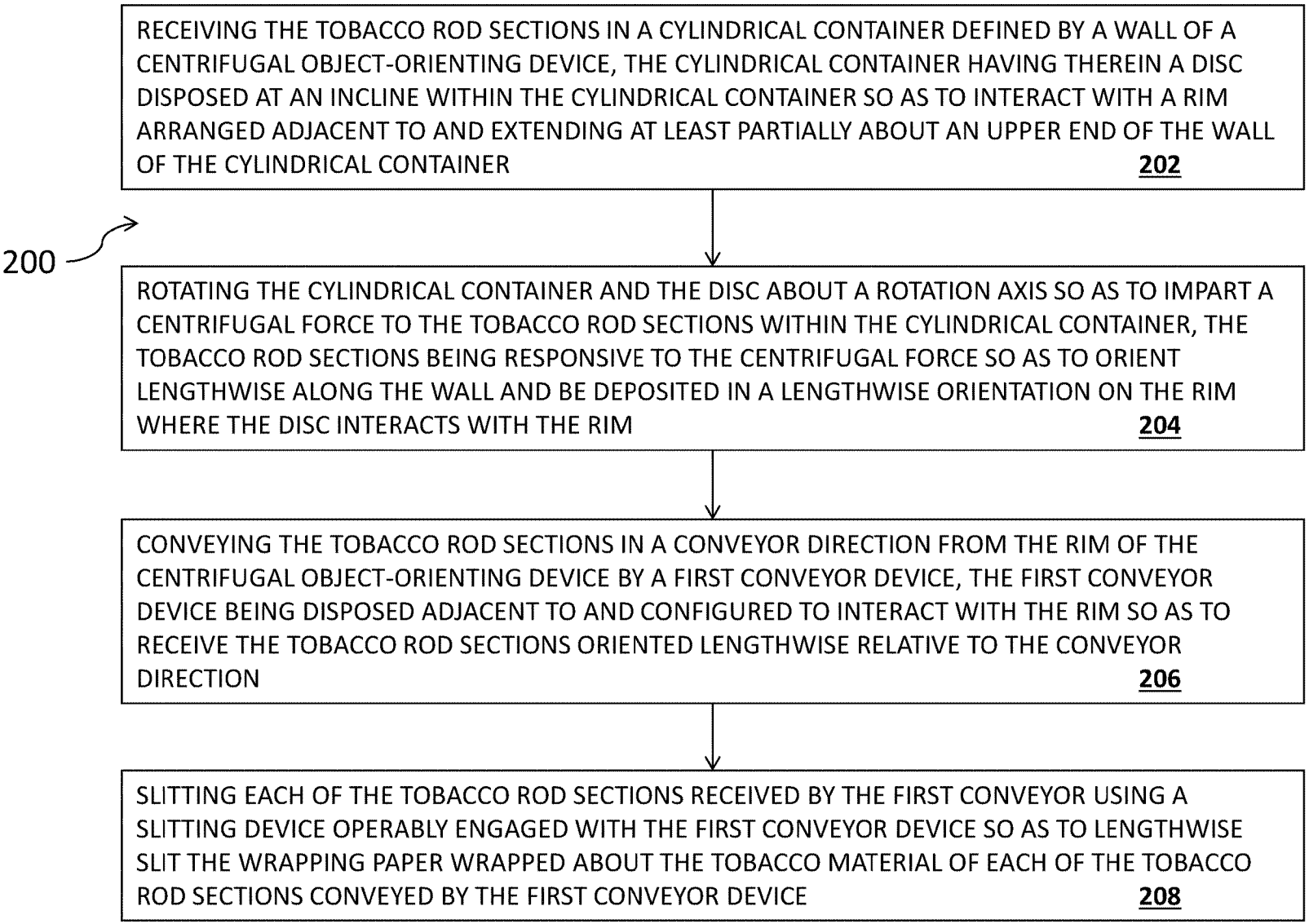

Having thus described the disclosure in general terms, reference will now be made to the accompanying drawings, which are not necessarily drawn to scale, and wherein:

FIG. 1 schematically illustrates a representative smoking article, such as a cigarette, possessing certain representative components of a smoking article, according to one aspect of the present disclosure;

FIG. 2 schematically illustrates a cross-sectional side view of continuously operable apparatus for recovering tobacco material, according to one aspect of the present disclosure;

FIG. 3 schematically illustrates a top view of the apparatus of FIG. 2; and FIG. 4 schematically illustrates a method of recovering tobacco material, according to one aspect of the present disclosure.

DETAILED DESCRIPTION OF THE PREFERRED EMBODIMENTS

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

Aspects and embodiments of the present disclosure may broadly relate, for example, to smoking article production apparatuses and methods, in particular, for rod-shaped smoking articles, such as cigarettes, wherein the smoking article includes a lighting end (i.e., an upstream end) associated with a tobacco rod section and a mouth end (i.e., a downstream end) associated with a filter section. In addition, aspects and embodiments of the present disclosure may broadly relate to apparatuses and methods for inspecting cigarettes and identifying any defective smoking cigarettes therein, at various points during the manufacture of a certain type of cigarette. Apparatuses and methods relating to smoking article production and/or inspecting and identifying any defective smoking articles is set forth and referenced, for example, in US Pat. Appl. Pub. No. 2016/0120213 to Ademe. Further aspects and embodiments of the present disclosure may be directed to consolidating defective cigarettes in a particular manner such that the defective cigarettes may then be subject to a tobacco recovery process.

Accordingly, some aspects of the present disclosure are directed to apparatuses and related methods for recovering tobacco material from tobacco rod sections, after the cigarette or smoking article has been inspected and identified as defective in any way and directed to the tobacco recovery process described in detail herein. A smoking article may be identified as "defective" in instances, for example and without limitation, where the smoking article may be missing the filter section; the tipping paper may be torn or improperly/incompletely applied; the air dilution perforations may be incompletely or improperly formed; the wrapping paper for the tobacco rod section may be torn or improperly formed; the tobacco rod section may have a low weight/density, a high weight/density, a soft spot, a hard spot, loose tobacco about the lighting end of the tobacco rod section, an improper density profile along the tobacco rod section; and/or a visible defect is present. As such, aspects of the present disclosure may further allow the tobacco recovery process to be automated, and to be capable of recovering the tobacco material from the certain type of cigarette, without contaminating the recovered tobacco material.

FIG. 1 illustrates a representative smoking article 10, such as a cigarette, possessing certain representative components of a smoking article. The cigarette includes a generally cylindrical rod 15 of a charge or roll of smokable filler material 16, such as tobacco, contained in a circumscribing wrapping paper 20. The rod is conventionally referred to as a "tobacco rod section." The ends of the tobacco rod section are open to expose the smokable filler material. The cigarette is shown as having one optional band 25 (e.g., a printed coating including a film-forming agent, such as starch, ethylcellulose, or sodium alginate) applied to the wrapping paper, and that band circumscribes the cigarette rod in a direction transverse to the longitudinal axis of the cigarette. That is, the band provides a cross-directional region relative to the longitudinal axis of the cigarette. The band can be printed on the inner surface of the wrapping paper (i.e., facing the smokable filler material) as shown, or less preferably, on the outer surface of the wrapping paper. Although the cigarette can possess a wrapping paper having one optional band, the cigarette also can possess wrapping paper having further optional spaced bands numbering two, three, or more.

The wrapping paper 20 of the tobacco rod section 15 can have a wide range of compositions and properties. The selection of a particular wrapping paper will be readily apparent to those skilled in the art of cigarette design and manufacture. Tobacco rod sections can have one layer of wrapping paper; or tobacco rod sections can have more than one layer of circumscribing wrapping paper, such as is the case for the so-called "double wrap" tobacco rod sections. Example types of wrapping papers, wrapping paper components and treated wrapping papers are described in U.S. Pat. No. 5,220,930 to Gentry; U.S. Pat. No. 7,275,548 to Hancock et al.; and U.S. Pat. No. 7,281,540 to Barnes et al.;

and PCT Application Pub. Nos. WO 2004/057986 to Hancock et al.; and WO 2004/047572 to Ashcraft et al.; which are incorporated herein by reference in their entireties.

At one end of the tobacco rod section 15 is the lighting end 28, and at the other end is positioned a filter element 30. The filter element may be positioned adjacent one end of the tobacco rod section such that the filter element and tobacco rod section are axially aligned in a serial or end-to-end relationship, preferably abutting one another. The filter element may have a generally cylindrical shape, and the diameter thereof may be essentially equal to the diameter of the tobacco rod section. The ends of the filter element permit the passage of air and smoke therethrough. The filter element may include filter material 40 (e.g., cellulose acetate tow impregnated with triacetin plasticizer) that is overwrapped along the longitudinally extending surface thereof with circumscribing plug wrap material 45. That is, the filter element is circumscribed along its outer circumference or longitudinal periphery by a layer of plug wrap, and each end is open to expose the filter material.

Within the filter element 30 may be positioned at least one object 50 (including, for example, capsules, pellets, strands), or various combinations of different objects. The number of objects within each filter element is often a pre-determined number, and that number can be 1, 2, 3, or more (i.e., at least one). In some aspects, each filter element may contain a plurality of objects disposed within the filter material 40 of the filter element, in some instances, particularly towards the central radial region of the filter element. In particular aspects, the nature of the filter material is such that the objects are secured or lodged in place (e.g., by friction) within the filter element.

The filter element 30 is attached to the tobacco rod section 15 using tipping material 58 (e.g., essentially air impermeable tipping paper), that circumscribes both the entire length of the filter element and an adjacent region of the tobacco rod section. The inner surface of the tipping material is fixedly secured to the outer surface of the plug wrap 45 and the outer surface of the wrapping paper 20 of the tobacco rod section, using a suitable adhesive; and hence, the filter element and the tobacco rod section are connected to one another.

The tipping material 58 connecting the filter element 30 to the tobacco rod section 15 can have indicia (not shown) printed thereon. For example, a band on the filter end of a cigarette (not shown) can visually indicate to a smoker the general locations or positions of the objects 50 within the filter element. These indicia may help the smoker to locate some objects so that they can, for example, be more easily ruptured by squeezing the filter element directly outside the position of any such rupturable object. The indicia on the tipping material may also indicate the nature of the payload carried by each object. For example, the indicia may indicate that the particular payload is a spearmint flavoring by having a particular color, shape, or design. If desired, the inner surface (i.e., the surface facing the plug wrap) of the tipping material can be coated with a material that can act to retard the propensity of rupturable object contents from migration, wicking or bleeding from the filter material into the tipping material, and hence causing what might be perceived as unsightly visible staining of the tipping material. Such a coating can be provided using a suitable film-forming agent (e.g., ethylcellulose, or a so-called lip release coating composition of the type commonly employed for cigarette manufacture).

A ventilated or air diluted smoking article can be provided with an optional air dilution provisions, such as a series of perforations 62, each of which extend through the tipping material and plug wrap. The optional perforations can be made by various techniques known to those of ordinary skill in the art, such as laser perforation techniques. As these techniques are carried out after insertion of any objects 50 into the filter element 30, care is taken to avoid damaging the objects during the formation of the perforations. One way to avoid damage from air dilution techniques, such as those employing laser perforation technologies, involves locating the perforations at a position adjacent to the positions of the objects. In such a manner, radiation, heat or physical forces acting upon the filter element during perforation processes do not have such a great propensity to damage the objects. Alternatively, so-called off-line air dilution techniques can be used (e.g., through the use of porous paper plug wrap and pre-perforated tipping paper). The perforated region can be positioned upstream of any object (as shown), or the perforated region can be positioned downstream of any object (i.e., towards the extreme mouth-end of the filter element).

The plug wrap 45 can vary. See, for example, U.S. Pat. No. 4,174,719 to Martin. Typically, the plug wrap is a porous or non-porous paper material. Plug wrap materials are commercially available. Example plug wrap papers are available from Schweitzer-Maudit International as Porowrap Plug Wrap 17-M1, 33-M1, 45-M1, 65-M9, 95-M9, 150-M4, 260-M4 and 260-M4T. Preferred plug wrap materials are non-porous in nature. Non-porous plug wraps exhibit porosities of less than about 10 CORESTA units, and preferably less than about 5 CORESTA units. Example non-porous plug wrap papers are available as Ref. No. 646 Grade from Olsany Facility (OP Paprina) of the Czech Republic (Trierendberg Holding). Plug wrap paper can be coated, particularly on the surface that faces the filter material, with a layer of a film-forming material. Such a coating can be provided using a suitable polymeric film-forming agent (e.g., ethylcellulose, ethylcellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

The use of non-porous plug wrap materials is desirable in order to avoid the contents of rupturable objects within filter elements from causing what might be perceived as unsightly visible staining of the tipping material 58. For example, highly non-porous plug wrap materials can act to retard or block the propensity of liquid contents of the rupturable objects from migration, wicking or bleeding from the filter material 40 into the tipping material.

Tobacco materials 16 useful for forming a smoking article can vary. Tobacco materials can be derived from various types of tobacco, such as flue-cured tobacco, burley tobacco, Oriental tobacco or Maryland tobacco, dark tobacco, dark-fired tobacco and *Rustica* tobaccos, as well as other rare or specialty tobaccos, or blends thereof. Descriptions of various types of tobaccos, growing practices, harvesting practices and curing practices are set for in *Tobacco Production, Chemistry and Technology*, Davis et al. (Eds.) (1999). Most preferably, the tobaccos are those that have been appropriately cured and aged.

Typically, tobacco materials 16 for cigarette manufacture are used in a so called "blended" form. For example, certain popular tobacco blends, commonly referred to as "American blends," comprise mixtures of flue-cured tobacco, burley tobacco and Oriental tobacco. Such blends, in many cases, contain tobacco materials that have a processed form, such as processed tobacco stems (e.g., cut-rolled or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes,* 3rd Ed., p. 43 (1990) and *Tobacco Production, Chemistry and Technology*, Davis et al. (Eds.) p. 346 (1999). Other representative tobacco types and types of tobacco blends also are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 7,025,066 to Lawson et al.; U.S. Pat. No. 7,240,678 to Crooks et al.; and U.S. Pat. No. 7,836,895 to Dube et al.; US Pat. Application Pub. Nos. 2004/0255965 to Perfetti et al; and 2005/0066986 to Nestor et al.; PCT Application Pub. No. WO 02/37990; and Bombick et al., *Fund. Appl. Toxicol.,* 39, p. 11-17 (1997).

Tobacco materials 16 typically are used in forms, and in manners, that are traditional for the manufacture of smoking articles, such as cigarettes. The tobacco normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco filler normally used within the tobacco rod section of a cigarette ranges from about 0.6 g to about 1 g. The tobacco filler normally is employed so as to fill the tobacco rod section at a packing density of about 100 mg/cm$^3$ to about 300 mg/cm$^3$, and often about 150 mg/cm$^3$ to about 275 mg/cm$^3$.

If desired, the tobacco materials 16 of the tobacco rod section 15 can further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

The dimensions of a representative cigarette 10 can vary. Preferred cigarettes are rod shaped, and can have diameters of about 7.5 mm (e.g., circumferences of about 22.5 mm to about 25 mm); and can have total lengths of about 80 mm to about 100 mm. The length of the filter element 30 can vary. Typical filter elements can have lengths of about 20 mm to about 40 mm. In some instances, the length of the filter element 30 is about 27 mm, and the length of the tobacco rod section 15 is about 56 mm to about 57 mm. In other instances, the length of the filter element is about 31 mm, and the length of the tobacco rod section is about 67 mm to about 68 mm. The tipping paper 58 can circumscribe the entire filter element and about 4 mm of the length of the tobacco rod section in the region adjacent to the filter element.

In use, the smoker lights the lighting end 28 of the cigarette 10 and draws smoke into his/her mouth through the filter element 30 at the opposite end of the cigarette. The smoker can smoke all or a portion of the cigarette with the objects 50 intact. During the portion of the smoking experience that any objects remain intact, smoke generated in the tobacco rod section 15 is drawn to the smoker through the filter material 40 of the filter element. Generally, the overall character or nature of the drawn smoke is virtually unaffected to any significant degree as a result of the presence of the intact object(s) within the filter element, unless particular objects are configured to be activated by or otherwise affect the drawn smoke. If desired, the smoker may rupture any or all of the rupturable objects at any time before, during, or even after, the smoking experience. Breakage of any rupturable object acts to release the contents that are contained and sealed therewithin. Release of the contents of any rupturable object into the filter element thus enables the smoker to achieve the intended benefit of action of certain of those contents, whether that benefit results from flavoring or scenting the smoke, cooling or moistening the smoke, freshening the scent of the cigarette butt, or achieving some other goal associated with modifying the overall composition of the smoke or altering the performance characteristics of the cigarette. That is, the contents of any rupturable object are not released into the filter element until the particular object is purposefully physically broken; but when a rupturable object is ruptured, a portion of component contained within the rupturable object (e.g., portions of a flavoring agent) that is consequently released into the filter element is incorporated into each subsequent puff of mainstream smoke that is received through that filter element. In this manner, any rupturable object can be ruptured by the smoker at their discretion. Multiple flavors or scents in or otherwise associated with the individual objects allows for different taste in each puff of the cigarette, or an increased amplitude of sensory response in each puff may be experienced by the smoker, if the flavor is the same in all objects. In some instances, relatively small objects may be incorporated in each filter element, due to the different manners in, and the different extent to, which the sensory responses may be affected when smoking the cigarette.

Cigarette rods and cigarette assemblies are manufactured using a cigarette making machine, such as a conventional automated cigarette rod making machine. Example cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; U.S. Pat. No. 6,904,917 to Kitao et al.; U.S. Pat. No. 7,210,486 to Hartmann; U.S. Pat. No. 7,234,471 to Fitzgerald et al.; U.S. Pat. No. 7,275,548 to Hancock et al.; and U.S. Pat. No. 7,281,540 to Barnes et al.; each of which is incorporated herein by reference.

Filter rods can be manufactured using a rod-making apparatus, and an example rod-making apparatus includes a rod-forming unit. Representative rod-forming units are available as KDF-2 and KDF-3E from Hauni-Werke Korber & Co. KG; and as Polaris-ITM Filter Maker from International Tobacco Machinery. Filter material, such as cellulose acetate filamentary tow, typically is processed using a conventional filter tow processing unit. For example, filter tow can be bloomed using bussel jet methodologies or threaded roll methodologies. An example tow processing unit has been commercially available as E-60 supplied by Arjay Equipment Corp., Winston-Salem, N.C. Other example tow processing units have been commercially available as AF-2, AF-3 and AF-4 from Hauni-Werke Korber & Co. KG. and as Candor-ITM Tow Processor from International Tobacco Machinery. Other types of commercially available tow processing equipment, as are known to those of ordinary skill in the art, can be employed. Multi-segment cigarette filter rods can be manufactured using a cigarette filter rod making device available under the brand name Mulfi from Hauni-Werke Korber & Co. KG.

Six-up rods, four-up filter rods and two-up rods that are conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,116 to Erdmann et al.; U.S. Pat. No. 4,281,670 to Heitmann et al.; U.S. Pat. No. 4,280,187 to Reuland et al.; U.S. Pat. No. 6,229,115 to Vos et al.; U.S. Pat. No. 7,296,578 to Read, Jr.; and U.S. Pat. No. 7,434,585 to Holmes; each of which is incorporated herein by reference. The operation of those types of devices will be readily apparent to those skilled in the art of automated cigarette manufacture.

The components and operation of conventional automated cigarette making machines will be readily apparent to those skilled in the art of cigarette making machinery design and operation, given the example equipment disclosed herein. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Application Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Various types of cigarette components, including tobacco types, tobacco blends, top dressing and casing materials, blend packing densities; types of paper wrapping papers for tobacco rod sections, types of tipping materials, and levels of air dilution, can be employed for making cigarettes with such automated cigarette making machines. See, for example, the various representative types of cigarette components, as well as the various cigarette designs, formats, configurations and characteristics, which are set forth in U.S. Pat. No. 5,220,930 to Gentry; U.S. Pat. No. 6,779,530 to Kraker; U.S. Pat. No. 7,237,559 to Ashcraft et al.; and U.S. Pat. No. 7,565,818 to Thomas et al.; and U.S. Patent Application Publication Nos. 2005/0066986 to Nestor et al.; and 2007/0246055 to Oglesby; each of which is incorporated herein by reference.

With such mass-production processes, there may be instances in which at least some of the produced cigarettes may exhibit defects that may render those cigarettes unsaleable. For example, the cigarette may be missing the filter section; the tipping paper may be torn or improperly/incompletely applied; the air dilution perforations may be incompletely or improperly formed; the wrapping paper for the tobacco rod section may be torn or improperly formed; the tobacco rod section may have a low weight/density, a high weight/density, a soft spot, a hard spot, loose tobacco about the lighting end of the tobacco rod section, an improper density profile along the tobacco rod section; and/or wherein the cigarette may include a visible defect. In such instances, the defective cigarettes may be directed to re-work or otherwise be discarded. In some cases, attempts may be made to recover the valuable tobacco from the defective/discarded cigarettes. Various tobacco reclamation schemes are disclosed, for example, in U.S. Pat. No. 4,278,100 to Thatcher; U.S. Pat. No. 4,191,199 to Sullivan; U.S. Pat. No. 4,221,035 to Thatcher; U.S. Pat. No. 4,763,673 to Barnes et al.; U.S. Pat. No. 4,867,179 to Leonard; U.S. Pat. No. 5,000,196 to Stewart et al.; U.S. Pat. No. 5,001,951 to Eisenlohr et al.; U.S. Pat. No. 5,117,843 to Holmes et al. and U.S. Pat. No. 6,510,855 to Korte et al. However, such tobacco reclamation schemes may have some drawbacks such as, for example, lack of automation, inefficiency, and the inability to recover tobacco from cigarettes having different defects.

Aspects of the present disclosure thus provide an automated and continuously operable tobacco reclamation scheme. In one such aspect and as schematically illustrated in FIGS. 2 and 3, a continuously operable apparatus 100 for recovering tobacco material from tobacco rod sections 15 of respective smoking articles 10 is illustrated. Such an apparatus 100 may, in some instances, comprise at least one rotatable drum 110 defining a longitudinal axis and a receiving surface extending along the longitudinal axis. The receiving surface may be further configured to define a plurality of channels 112, each being configured to receive a smoking article 10 such that the smoking article received in a channel is arranged in parallel with the longitudinal axis of the at least one drum. As shown in FIG. 1, each tobacco rod section 15 includes a wrapping paper 20 wrapped about the tobacco material 16, wherein the smoking article 10 includes the tobacco rod section serially engaged with a filter section or segment 30, wherein the tobacco rod section and the filter section or segment may be joined together by a tipping paper 58.

As schematically shown in FIGS. 2 and 3, at least one inspection device 114 may be arranged in relation to the smoking articles/cigarettes 10 in the channels 112 of the at least one drum 110. In such a relation, the inspection device may be further configured to inspect each of the smoking articles in the channels of the at least one drum and/or to determine whether any of the smoking articles are defective. The inspection device may comprise an optical inspection device (e.g., a camera), an x-ray inspection device, or the like. In some aspects, the inspection device and the rotatable drum are combined such that the rotatable drum acts as the inspection device. For example, in one aspect, the rotatable drum is capable of weighing each of the smoking articles received in its channels to identify if any are defective in terms of weight.

The inspection device may be further configured to direct any defective smoking articles away from the at least one drum. Further, in some aspects, a rotatable sampling drum 116 may be in communication with the at least one drum 110 and configured to receive the defective smoking articles therefrom. That is, the sampling drum may be disposed and arranged to interact directly with the at least one drum to receive the identified-as-defective smoking articles directly therefrom. Like the at least one drum, the rotatable sampling drum may define a longitudinal axis and a receiving surface extending along the longitudinal axis. The receiving surface may be configured to define a plurality of channels 118. The plurality of channels of the rotating sampling drum may each be configured to receive an identified-as-defective smoking article such that the defective smoking article in the channel is arranged in parallel with the longitudinal axis of the rotating sampling drum.

In other instances, one or more intermediate rotatable drums (not shown) may be disposed between the sampling drum and the at least one drum, wherein the defective smoking articles are conveyed from the at least one drum to one or more of the intermediate drums, and then to the sampling drum. In yet other aspects, the defective smoking articles may be directed to the sampling drum from the at least one drum by another suitable mechanism, device, or arrangement that may or may not include the intermediate drum(s). For example, a transfer arrangement (not shown) may be configured to direct defective smoking articles, following determination thereof, from the at least one drum to the sampling drum.

In some further aspects, a severing device 120 may be disposed adjacent to the sampling drum 116, with the severing device being arranged and configured to sever each of the defective smoking articles received by the sampling drum along the length of the tobacco rod section of the respective defective smoking article 10, so as to separate at least a portion of the tobacco rod section 15 from a remaining portion of the defective smoking article including the filter segment/section 30. The severing device may be configured to rotate about a rotating axis. A sharpening device 122 may be provided adjacent to the severing device and configured to continuously sharpen the severing device. For example, the sharpening device 122 may be a rotating whetstone that is in contact with an edge of the rotating severing device. Apparatuses and methods relating to smoking article production and/or inspecting and identifying any defective smoking articles is set forth and referenced, for example, in US Pat. Appl. Pub. No. 2016/0120213 to Ademe.

Once the defective smoking articles received by the sampling drum 116 are severed by the severing device 120, the severed smoking articles may be released or otherwise directed outwardly of the channels 118 of the sampling drum. In such instances, the severing device and/or the sampling drum may be configured to direct the severed portion of the tobacco rod section 15 away from the remaining portion of the defective smoking article including the filter segment/section 30. That is, a possible source of contamination of the recovered tobacco (i.e., the filter segment/section) is removed and separated from the remaining portion of the tobacco rod section, following severance thereof by the severing device. In some instances, the severing device, itself, may be configured and arranged to provide the required separation of the severed portions of the smoking article. For example, a partition device 124 in combination with the severing device may cooperate to separate the filter segment/section from the tobacco rod section 15. A gravity-fed chute arrangement 126 may be positioned adjacent to the severing device so that after the severing device severs the defective smoking article received by the sampling drum, the filter segment/section remains within the channels of the sampling drum to be deposited onto the partition device, while the tobacco rod section 15 is directed onto the gravity-fed chute. That is, the chute arrangement may be arranged to collect the severed portion of the smoking article including the severed tobacco rod section, while the partition device may be arranged to collect the remaining portion including the filter segment/section 30 of the smoking article. One skilled in the art, however, will appreciate that many different arrangements may be provided for separating and segregating the respective severed portions of the smoking articles such that at least the severed portions of the tobacco rod segments/sections (not including the filter rod segments/sections) can be separately collected. Notably, each of the collected severed portions of the tobacco rod/sections (not including the filter rod segments/sections) includes tobacco material lengthwise-wrapped with a wrapping paper 20.

The gravity fed chute 126 or the arrangement otherwise used to collect the severed portions of the tobacco rod sections 15 may be disposed at an incline and directed toward a centrifugal object-orienting device 128. In other aspects, the gravity fed chute 126 may be positioned adjacent to a conveyor device 129 (e.g., a second conveyor device, as compared to a first conveyor device described in further detail herein), wherein the conveyor device 129 is configured to receive the severed portions of the tobacco rod sections from the gravity fed chute 126. In either instance, the severed portions of the tobacco rod sections are conveyed to a cylindrical container of the centrifugal object-orienting device 128.

The second conveyor device 129 may extend over the cylindrical container of the centrifugal object-orienting device 128 and be configured to continuously deposit the tobacco-rod sections 15 therein. In some aspects, the second conveyor device 129 is positioned such that the tobacco-rod sections are deposited away from or off-center from a central axis A of the cylindrical container of the centrifugal object-orienting device. Such a conveyor device may be provided, in some instances, for example, by a flat belt conveyor device from MiSUMi.

The centrifugal object-orienting device 128 (e.g., the cylindrical container thereof) may be configured to collect the portions of the severed portions of the tobacco rod sections (not including the filter rod segments/sections 30) and orient the severed portions in a particular orientation (i.e., with the longitudinal axes thereof arranged tangentially to the wall of the cylindrical container), and to then feed the severed portions of the tobacco rod sections (not including the filter rod segments/sections) individually in a direction along the respective longitudinal axes thereof. Such a centrifugal object-orienting device may be accomplished, in some instances, by implementing a commercially available machine such as, for example, a centrifugal feeder device from Shibuya Hoppmann.

More particularly, and as illustrated in FIGS. 2 and 3, the cylindrical container of the centrifugal object-orienting device 128 may comprise a wall 130 defining the cylindrical container 132, wherein the cylindrical container is arranged to receive the tobacco rod sections and defines the central axis A therein. In some aspects, the cylindrical container 132 may comprise a bowl shape, where the bowl is substantially circular in cross-section. As illustrated in at least FIG. 3, for example, the cylindrical container has a substantially circular cross-section. In some aspects, a rim 134 may be arranged adjacent to and extending at least partially about an upper end of the wall. The rim may be sized to accommodate continuous metering of the tobacco rod sections 15 received in a lengthwise orientation therealong from the cylindrical container.

The centrifugal-object orienting device 128 may further comprise a disc 136 disposed at an incline I within the cylindrical container 132 and so as to interact with the rim 134. The incline I may be angularly offset from the central axis A or offset from the vertical at an angle between about 15 degrees and about 25 degrees. In some aspects, for example, the disc defines a conical top surface or otherwise gradually increases in thickness from an outer edge towards a center of the disc. The disc may be inclined within the cylindrical container so that at least a portion of the disc extends to the rim of the cylindrical container, such that the top surface of the disc is substantially coplanar with the rim.

The cylindrical container 132 may be rotatable about the central axis A, while the disc 136 may be rotatable about a rotation axis R, such that the rotating cylindrical container and disc cooperate to impart centrifugal force to the tobacco rod sections 15 within the cylindrical container. Rotation of the cylindrical container and the disc may be clockwise or counter-clockwise. The tobacco rod sections may be responsive to the centrifugal force imparted thereto by the rotation of the cylindrical container and the disc to orient lengthwise along the wall 130 (e.g., the tobacco rod sections oriented such that the longitudinal axes thereof are arranged tangentially to the wall 130 of the cylindrical container 132) and be deposited in a lengthwise orientation on the rim 134 where the disc interacts with the rim. Specifically, the tobacco rod sections within the cylindrical container, in response to the centrifugal force imparted thereto by the incline and rotation of the disc, in conjunction with the rotation of the cylindrical container, are individually and serially deposited onto the rim of the cylindrical container.

In some aspects, the centrifugal force imparted to the tobacco rod sections 15 in the cylindrical container 132 may cause some of the tobacco material 16 in the tobacco rod sections to become dislodged or loosened therefrom. As such, the disc 136 and/or a bottom surface 138 of the cylindrical container may be perforated so that loosened tobacco material 16 may be sifted therethrough and collected by a preliminary tobacco recovery system 140. The preliminary tobacco recovery system may be provided directly below the perforated disc or may be provided below the perforated bottom surface of the cylindrical container (as shown in FIG. 2). The preliminary tobacco recovery system may include a container to collect the dislodged tobacco material, a gravity-fed chute to transport the dislodged tobacco material, or the like. Other preliminary tobacco recovery systems are also contemplated.

The apparatus 100 may further comprise a first conveyor device 142 located downstream of the centrifugal-object orienting device 128. The first conveyor device may be disposed adjacent to and may be configured to interact with the rim 134 so as to receive and convey in a conveyor direction the tobacco rod sections 15 from the rim, with the tobacco rod sections being oriented lengthwise relative to the conveyor direction. The first conveyor device may be substantially parallel to the top surface of the disc such that the tobacco rod sections may be continuously received thereon from the disc.

In some aspects, a first diverter device 144 may be engaged between the rim 134 of the cylindrical container 132 and the first conveyor device 142 so as to normally direct the lengthwise-oriented tobacco rod sections 15 from the rim to the first conveyor device. The first diverter device may be a partition, as illustrated in FIG. 3, which is configured to direct a single-file sequence of the lengthwise-oriented tobacco rod sections from the rim outwardly of the cylindrical container, while diverting those tobacco rod sections that are not properly oriented or are side-by-side with another tobacco rod section back into the cylindrical container. The first diverter device may be engaged with the first conveyor device so that single file sequence of the lengthwise-oriented tobacco rod sections that are diverted from the rim of the cylindrical container are continuously directed and conveyed to the first conveyor device.

In some other aspects, a second diverter device 146 may be arranged about the rim 134 of the cylindrical container 132, between the interaction of the disc 136 with the rim and the first diverter device 144. For example, as illustrated in FIG. 3, the second diverter device may be arranged prior to the first diverter device with respect to the direction of rotation of the cylindrical container/disc, and may be selectively actuatable to divert tobacco rod sections 15 deposited on the rim back into the cylindrical container. For example, the second diverter device may include a barrier positioned above a surface of the rim and rotatable about one end thereof into and out of the path of the tobacco rod sections that are oriented lengthwise around the rim. In the event of, for example, a processing issue of the tobacco rod sections at the first diverter device 144, at the first conveyor device 142, or processing equipment downstream therefrom, the second diverter device 146 may be actuated into the path of the tobacco rod sections on the rim to direct subsequent tobacco rod sections on the rim back into the cylindrical container. In this manner, the centrifugal-object orienting device 128 can continue to operate while the downstream processing issue(s) are resolved. Other mechanisms for the first and/or second diverter device are contemplated as well.

The apparatus 100 may further comprise a slitting device 148 operably engaged with the first conveyor device 142 and configured to lengthwise slit the wrapping paper 20 wrapped about the tobacco material 16 of each of the tobacco rod sections 15 conveyed by the first conveyor device. The slitting device may be arranged lengthwise relative to the first conveyor device so as to slit or cut at least one surface of the wrapping paper of the tobacco rod section enclosing the tobacco material.

In some aspects, the tobacco rod section may be fed along the first conveyor device 142 towards the slitting device 148 and aligned therewith by an alignment arrangement 150. For example, the alignment arrangement may comprise rotatable feed members arranged on opposing sides of the first conveyor device. More particularly, the rotatable feed members may each be rotated in opposite directions (i.e., one rotating counter-clockwise and the other rotating clockwise), and sufficiently spaced apart on either side of the first conveyor device, so as to grip each tobacco rod section 15 and move the tobacco rod section into engagement with the slitting device along the conveyor direction.

Following lengthwise slitting of the wrapping paper 20, the apparatus 100 may also include, for example, a tobacco recovery device 152 configured and arranged to recover the tobacco material 16 from the respective tobacco rod sections 15. Specifically, and as illustrated in FIGS. 2 and 3, the tobacco recovery device 152 may be operably engaged with the first conveyor device 142 or the slitting device 148. In this manner, the tobacco recovery device may be configured to receive the slit tobacco rod sections, and separate the wrapping paper from the tobacco material for recovery of the tobacco material.

In some aspects, the tobacco recovery device 152 may comprise a vibrating screen 154. The vibrating screen may comprise a grate/sieve configured, arranged, and sized so as to allow the tobacco material 16 to pass therethrough, while preventing the wrapping paper 20 from passing through. In order to facilitate the tobacco material/wrapping paper separation process, the grate/sieve may be vibrated, for example, by a vibrating device (not shown).

In this manner, for example, the vibrating screen 154 may be configured to loosen the tobacco material 16 from the wrapping paper 20, to sift the tobacco material, and to recover the tobacco material on an opposing side of the vibrating screen. The tobacco recovery device 152 may also comprise suction device 156 arranged about the opposing side of the vibrating screen. The suction device may be configured to apply negative pressure to the vibrating screen to facilitate sifting of the tobacco material loosened from the wrapping paper through the vibrating screen. In addition to, or instead of the suction device, a collection box may be provided on the opposing side of the vibrating screen to recover the tobacco material sifted through the vibrating screen.

Once the wrapping paper 20 is separated from the tobacco material 16, the wrapping paper waste may be collected from the vibrating screen 154 and discarded. The tobacco material collected by the collection box, suction device 156, or the like may be re-directed at least back to a tobacco rod section forming portion of a manufacturing apparatus so as to be used in the further production of new smoking articles. Such re-direction may be accomplished, for example, through physical transportation of the collection box, or by way of negative pressure through a chute or channel leading from the suction device back to a tobacco rod section forming portion of a production apparatus.

FIG. 4 schematically illustrates a method 200 of recovering tobacco material, according to one aspect of the present disclosure. The method may include recovering tobacco material from tobacco rod sections 15 such as those illustrated in FIG. 1. Each of the tobacco rod sections may include a wrapping paper 20 wrapped about the tobacco material 16.

In some aspects, the method 200 includes receiving the tobacco rod sections in a cylindrical container defined by a wall of a centrifugal object-orienting device, the cylindrical container having therein a disc disposed at an incline within the cylindrical container so as to interact with a rim arranged adjacent to and extending at least partially about an upper end of the wall of the cylindrical container, in a first step 202.

In some aspects, the method 200 includes rotating the cylindrical container and the disc about a rotation axis so as to impart a centrifugal force to the tobacco rod sections within the cylindrical container, the tobacco rod sections being responsive to the centrifugal force so as to orient lengthwise along the wall and be deposited in a lengthwise orientation on the rim where the disc interacts with the rim, in a second step 204.

In some aspects, the method 200 includes conveying the tobacco rod sections in a conveyor direction from the rim of the centrifugal object-orienting device by a first conveyor device, the first conveyor device being disposed adjacent to and configured to interact with the rim so as to receive the tobacco rod sections oriented lengthwise relative to the conveyor direction, in a third step 206.

In some aspects, the method 200 includes slitting each of the tobacco rod sections received by the first conveyor using a slitting device operably engaged with the first conveyor device so as to lengthwise slit the wrapping paper wrapped about the tobacco material of each of the tobacco rod sections conveyed by the first conveyor device, in a fourth step 208.

Accordingly, the method 200 for recovery of the tobacco material, as disclosed herein, may be accomplished in a continuous process, with the associated apparatus being appropriately configured and arranged for performing such a continuous process, as shown, for example, in FIGS. 2 and 3. For example, such a continuous process may involve an online production system comprised of a plurality of cooperating and interacting machines or devices. In other instances, the continuous process may be incorporated into a single online production machine or device (i.e., by suitably modifying a production device such as a Protos device commercially available from Hauni). In such aspects, the smoking article manufacturing process and inspection provisions, as well as the identification and segregation of "defective" smoking articles and deconstruction of the defective smoking articles for the recovery of the tobacco material, may be accomplished in an automated manner and at normal production rate of the device/system (i.e., at speeds normally associated with the operating device/system for producing such smoking articles).

In light of possible interrelationships between aspects of the present disclosure in providing the noted benefits and advantages associated therewith, the present disclosure thus particularly and explicitly includes, without limitation, embodiments representing various combinations of the disclosed aspects. Thus, the present disclosure includes any combination of two, three, four, or more features or elements set forth in this disclosure, regardless of whether such features or elements are expressly combined or otherwise recited in a specific embodiment description herein. This disclosure is intended to be read holistically such that any separable features or elements of the disclosure, in any of its aspects and embodiments, should be viewed as intended, namely to be combinable, unless the context of the disclosure clearly dictates otherwise.

Many modifications and other aspects of the disclosures set forth herein will thus come to mind to one skilled in the art to which these disclosures pertain having the benefit of the teachings presented in the foregoing descriptions and the associated drawings. For example, those of skill in the art will appreciate that embodiments not expressly illustrated herein may be practiced within the scope of the present disclosure, including that features described herein for different embodiments may be combined with each other and/or with currently-known or future-developed technologies while remaining within the scope of the claims presented here. Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation.

That which is claimed:

1. An apparatus for recovering material contained within products, the apparatus comprising:

a centrifugal object-orienting device being rotatable about a rotation axis such that the rotating centrifugal object-orienting device imparts centrifugal force to the products to orient the products along a circumferential portion of the centrifugal object-orienting device, wherein the centrifugal object-orienting device comprises a wall defining a cylindrical container arranged to receive the products and defining a central axis therein, the circumferential portion including a rim arranged adjacent to and extending at least partially about an upper end of the wall, and a perforated disc disposed at an incline within the cylindrical container and so as to interact with the rim;

a first conveyor device disposed adjacent to and configured to interact with the rim so as to receive and convey in a conveyor direction the products from the rim;

a slitting device operably engaged with the first conveyor device and configured to slit a covering containing the material of each of the products conveyed by the first conveyor device;

at least one diverter device arranged to divert the products from the circumferential portion of the centrifugal object-orienting device so as to recover material therefrom; and a recovery system disposed below the perforated disc, the recovery system being configured to recover the material dislodged by the centrifugal force imparted to the product within the cylindrical container and directed through the perforated disc.

2. The apparatus according to claim 1, wherein the at least one diverter device comprises a first diverter device engaged between the rim of the cylindrical container and the first conveyor device, the first diverter device being configured to divert the products from the rim to the first conveyor device.

3. The apparatus according to claim 2, wherein the at least one diverter device further comprises a second diverter device arranged about the rim of the cylindrical container, between the interaction of the disc with the rim and the first diverter device, the second diverter device being selectively actuatable to divert products deposited on the rim back into the cylindrical container.

4. The apparatus according to claim 1, further comprising a repository configured to receive the products.

5. The apparatus according to claim 4, further comprising a second conveyor device configured to receive the products and to convey the products to the cylindrical container of the centrifugal object-orienting device.

6. The apparatus according to claim 1, further comprising a recovery device operably engaged with the first conveyor device or the slitting device, the recovery device being configured to receive the slit products, and separate the covering from the material for recovery of the material.

7. The apparatus according to claim 6, wherein the recovery device comprises a vibrating screen configured to loosen the material from the covering, to sift the material, and to recover the material on an opposing side of the vibrating screen.

8. The apparatus according to claim 1, further comprising an alignment arrangement operably engaged with the first conveyor device and configured to align the products with the slitting device such that each product is slit along substantially a full length thereof.

9. A method of recovering material from products, the method comprising:

receiving the products in a centrifugal object-orienting device that is rotatable about a rotation axis such that the rotating centrifugal object-orienting device imparts centrifugal force to the products to orient along a circumferential portion of the centrifugal object-orienting device, wherein the centrifugal object-orienting device comprises a wall defining a cylindrical container arranged to receive the products and defining a central axis therein, the circumferential portion including a rim arranged adjacent to and extending at least partially about an upper end of the wall, and a perforated disc disposed at an incline within the cylindrical container and so as to interact with the rim;

rotating the cylindrical container and the disc about a rotation axis so as to impart a centrifugal force to the products within the cylindrical container, the products being responsive to the centrifugal force so as to orient along the wall and be deposited in a on the rim where the disc interacts with the rim;

conveying the products in a conveyor direction from the rim of the centrifugal object-orienting device by a first conveyor device, the first conveyor device being disposed adjacent to and configured to interact with the rim so as to receive the products;

slitting each of the products received by the first conveyor using a slitting device operably engaged with the first conveyor device so as to slit a covering containing the material of each of the products conveyed by the first conveyor device;

diverting the products from the circumferential portion of the centrifugal object-orienting device using at least one diverter device so as to recover material therefrom; and recovering the material dislodged by the centrifugal force imparted to the product within the cylindrical container and directed through the perforated disc using a recovery system disposed below the perforated disc.

10. The method according to claim 9, further comprising diverting the products from the rim to the first conveyor device in the conveyor direction using a first diverter device engaged between the rim of the cylindrical container and the first conveyor device.

11. The method according to claim 10, further comprising selectively diverting products deposited on the rim back into the cylindrical container using a second diverter device arranged about the rim of the cylindrical container, between the interaction of the disc with the rim and the first diverter device.

12. The method according to claim 9, further comprising receiving products from a repository.

13. The method according to claim 12, further comprising conveying the products in the conveyor direction to the cylindrical container of the centrifugal object-orienting device using a second conveyor device, the second conveyor device being disposed adjacent to the repository so as to receive the products.

14. The method according to claim 9, further comprising separating the covering from the material to recover the material using a recovery device operably engaged with the first conveyor device or the slitting device, the recovery device being configured to receive the slit products from the first conveyor device.

15. The method according to claim 14, wherein the recovery device comprises a screen, and wherein separating the covering from the material comprises vibrating the screen of the recovery device in receipt of the slit products so as to loosen the material from the covering, sift the material, and recover the material on an opposing side of the vibrating screen.

16. The method according to claim 9, further comprising aligning the products with the slitting device using an alignment arrangement operably engaged with the first conveyor device such that each product is slit along a substantially full length thereof.

17. An apparatus for recovering material contained within products, the apparatus comprising:

a centrifugal object-orienting device being rotatable about a rotation axis such that the rotating centrifugal object-orienting device imparts centrifugal force to the products to orient the products along a circumferential portion of the centrifugal object-orienting device, wherein the centrifugal object-orienting device comprises a wall defining a cylindrical container arranged to receive the products and defining a central axis therein, the circumferential portion including a rim arranged adjacent to and extending at least partially about an upper end of the wall, and a disc disposed at an incline within the cylindrical container and so as to interact with the rim;

a first conveyor device disposed adjacent to and configured to interact with the rim so as to receive and convey in a conveyor direction the products from the rim;

a slitting device operably engaged with the first conveyor device and configured to slit a covering containing the material of each of the products conveyed by the first conveyor device; and at least one diverter device arranged to divert the products from the circumferential portion of the centrifugal object-orienting device so as to recover material therefrom, wherein the at least one diverter device comprises a first diverter device engaged between the rim of the cylindrical container and the first conveyor device, the first diverter device being configured to divert the products from the rim to the first conveyor device, and wherein the at least one diverter device further comprises a second diverter device arranged about the rim of the cylindrical container, between the interaction of the disc with the rim and the first diverter device, the second diverter device being selectively actuatable to divert products deposited on the rim back into the cylindrical container.

18. The apparatus according to claim 17, further comprising a repository configured to receive the products.

19. The apparatus according to claim 17, further comprising a second conveyor device configured to receive the products and to convey the products to the cylindrical container of the centrifugal object-orienting device.

20. The apparatus according to claim 17, further comprising a recovery device operably engaged with the first conveyor device or the slitting device, the recovery device being configured to receive the slit products, and separate the covering from the material for recovery of the material.

21. The apparatus according to claim 20, wherein the recovery device comprises a vibrating screen configured to loosen the material from the covering, to sift the material, and to recover the material on an opposing side of the vibrating screen.

22. The apparatus according to claim 17, further comprising an alignment arrangement operably engaged with the first conveyor device and configured to align the products with the slitting device such that each product is slit along substantially a full length thereof.

23. A method of recovering material from products, the method comprising:

receiving the products in a centrifugal object-orienting device that is rotatable about a rotation axis such that the rotating centrifugal object-orienting device imparts centrifugal force to the products to orient along a circumferential portion of the centrifugal object-orienting device, wherein the centrifugal object-orienting device comprises a wall defining a cylindrical container arranged to receive the products and defining a central axis therein, the circumferential portion including a rim arranged adjacent to and extending at least partially about an upper end of the wall, and a disc disposed at an incline within the cylindrical container and so as to interact with the rim;

rotating the cylindrical container and the disc about a rotation axis so as to impart a centrifugal force to the products within the cylindrical container, the products being responsive to the centrifugal force so as to orient along the wall and be deposited in a on the rim where the disc interacts with the rim;

conveying the products in a conveyor direction from the rim of the centrifugal object-orienting device by a first conveyor device including a first diverter device engaged between the rim of the cylindrical container and the first conveyor device, the first conveyor device being disposed adjacent to and configured to interact with the rim so as to receive the products;

selectively diverting products deposited on the rim back into the cylindrical container using a second diverter device arranged about the rim of the cylindrical container, between the interaction of the disc with the rim and the first diverter device;

slitting each of the products received by the first conveyor using a slitting device operably engaged with the first conveyor device so as to slit a covering containing the material of each of the products conveyed by the first conveyor device; and diverting the products from the circumferential portion of the centrifugal object-orienting device using at least one diverter device so as to recover material therefrom.

24. The method according to claim 23, further comprising receiving products from a repository.

25. The method according to claim 23, further comprising conveying the products in the conveyor direction to the cylindrical container of the centrifugal object-orienting device using a second conveyor device, the second conveyor device being disposed adjacent to the repository so as to receive the products.

26. The method according to claim 23, further comprising separating the covering from the material to recover the material using a recovery device operably engaged with the first conveyor device or the slitting device, the recovery device being configured to receive the slit products from the first conveyor device.

27. The method according to claim 26, wherein the recovery device comprises a screen, and wherein separating the covering from the material comprises vibrating the screen of the recovery device in receipt of the slit products so as to loosen the material from the covering, sift the material, and recover the material on an opposing side of the vibrating screen.

28. The method according to claim 23, further comprising aligning the products with the slitting device using an alignment arrangement operably engaged with the first conveyor device such that each product is slit along a substantially full length thereof.

* * * * *